United States Patent [19]

Krause

[11] Patent Number: 4,807,414

[45] Date of Patent: Feb. 28, 1989

[54] ROOF PANEL LOCKING SYSTEM

[76] Inventor: Gary L. Krause, 2270 W. Buell, Lake Orion, Mich. 48035

[21] Appl. No.: 104,089

[22] Filed: Oct. 5, 1987

[51] Int. Cl.[4] ..... E04D 1/34

[52] U.S. Cl. ..... 52/478; 52/520; 52/545; 52/573

[58] Field of Search ..... 52/545, 478, 520, 573

[56] References Cited

U.S. PATENT DOCUMENTS

| | | | |
|---|---|---|---|
| 2,857,995 | 10/1958 | Boulton | 52/520 |
| 3,388,518 | 6/1968 | Scott | 52/478 |
| 4,034,532 | 7/1977 | Reinwall, Jr. | 52/520 |
| 4,213,282 | 7/1980 | Heckelsberg | 52/478 |
| 4,288,958 | 9/1981 | Chalmers et al. | 52/478 |
| 4,495,743 | 1/1985 | Ellison et al. | 52/520 |
| 4,514,952 | 5/1985 | Johansson | 52/520 |
| 4,570,404 | 2/1986 | Knudson | 52/545 |
| 4,575,983 | 3/1986 | Lott, Jr. et al. | 52/520 |
| 4,741,142 | 5/1988 | Otto et al. | 52/545 |

FOREIGN PATENT DOCUMENTS

| | | | |
|---|---|---|---|
| 2248886 | 4/1973 | Fed. Rep. of Germany | 52/545 |

*Primary Examiner*—David A. Scherbel
*Assistant Examiner*—Caroline D. Dennison
*Attorney, Agent, or Firm*—Shoemaker and Mattare, Ltd.

[57] ABSTRACT

This invention relates to a roof panel locking system which allows for roof panel expansion and contraction due to temperature variations while providing protection against panel wear due to such expansion and contraction.

7 Claims, 1 Drawing Sheet

ROOF PANEL LOCKING SYSTEM

BACKGROUND OF THE INVENTION

Corrugated sheet metal roof paneling has been considerably improved over the years and is now recognized as a good economical and practical roofing material.

In general, the roofing panels are rolled from sheet metal in corrugated form and lengths sufficient to extend from the ridge of the roof being constructed to the eaves. And, next adjacent panels are made to overlap each other and to be locked together in some manner and thereby provide a wide expansive roof covering.

One well recognized and accepted system, which is known as the standing seam ROOF-LOK system, is offered by Architectural Panels, Inc. of Pontiac, Mich., and makes use of upturned edges on the next adjacent panels which interfit and are so formed that they lock together, with the use of a motorized seaming tool, to provide what is known in the trade as a "rib lock" arrangement.

Of particular note in this system is the manner in which the roof panels are fastened to the roof supporting structure.

This is accomplished by the use of a fastener or clip that is received between two next adjacent roof panels, at spaced intervals along their length, and which is itself formed to interfit between the two panel edges in the course of having them seal rolled together. The fastener or clip is also formed to include a lower end, that extends below the plane of the roof panels, and which is turned back on itself to provide a hook or catch that can be engaged with the roof supporting structure or to other receptive means fastened to the roof supporting structure.

Presently, and in the structure disclosed hereinafter, a receptive or so-called base member is used that has an elongated opening formed centrally therewithin and which is provided with an overturned edge that serves as a complimentary hook or catch for the lower end of the fastener or clip to be engaged with it. And, with the fastener or clip allowed relative movement in the elongated opening and on the base member during the relative expansion and contraction of the roof panels due to temperature changes. Accordingly, with the base member fastened to the roof supporting structure, the fastener or clip engaged to the base member and also in seam locked engagement between next adjacent roof panels, the panels themselves are retained and held on the roof supporting structure.

By making the receptive hook or catch that is provided on the base member longer in length than the width of the hook or catch on the lower end of the fastener or clip, the fastener or clip is allowed the relative movement mentioned which in turn allows for the eave-to-ridge expansion and contraction of the roof panels.

Although this system works very well, there is friction and wear that occurs between the roof panels and the base member that the fastener or clip is engaged to. And, since the roof panel expansion for a hundred foot length, with a temperature variation of 100 degrees, will be a much as 1.6 inches, it can be appreciated that there is a significant amount of relative movement that can occur with large expansive roofs and where the friction and wear between the roof panels and the means provided to retain them on their supporting structure could have serious consequences.

SUMMARY OF THE PRESENT INVENTION

It is an object of the present invention to eliminate and/or significantly reduce the amount of friction and wear that occurs between the fastener or clip used with a standing-seam ridge locked sheet metal roof system and the roof panels themselves.

This is accomplished, according to the present invention, by having an isolator plate that is disposed between the base member and the roof panels and which is slotted to receive the lower end of the fastener or clip through it in the course of its engagement with the base member.

Any relative movement of the panels, which is transmitted to the fastener or clip, since they are locked together, will in turn cause the isolator plate to be relatively moved on the base member, rather than having the roof panels themselves rub and wear on the base member.

The clip moves relatively, as the roof panels expand and contract due to temperature changes, since it is fastened to the roof panels, and slides or moves lengthwise on the base member, due to its hooked engagement therewith. And, as it does so it causes the isolator plate to move with it; thereby providing a wear surface under the roof panels and between them and the base member fastener.

IN THE DRAWING FIGURES

DESCRIPTION OF ILLUSTRATED EMBODIMENT OF THE INVENTION

Figure 1:
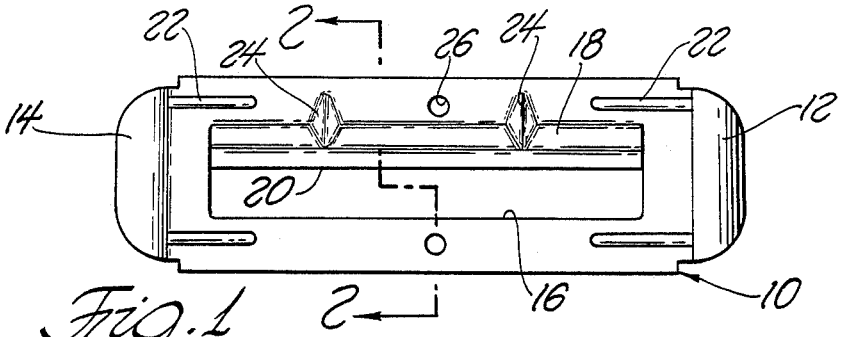
FIG. 1 is a plan view of the base member of the present roof panel fastener system.

The base member part 10 is shown in the drawing FIG. 1.

It includes an elongated plate with its ends 12 and 14 turned up and formed to provide rub rails, as best shown in the second drawing figure and as will be better appreciated later on. The base member has an elongated opening 16 centrally thereof and between its two ends and which has one of its side edges 18 formed to provide a downwardly open hooked edge 20, again best shown in the second drawing figure.

The base member is formed to include strengthening ribs 22 near its upturned ends 12 and 14 and behind the hooked edge 20, as at 24. And it has fastening holes 26 with which to fix it to a roof supporting cross brace or girt; as will be later shown.

Figure 2:
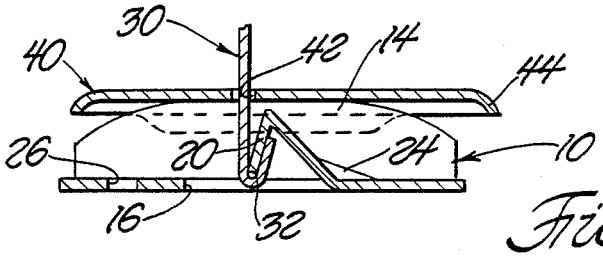
FIG. 2 is a cross-sectional view of the base member shown in the first drawing figure, as seen in the plane of line 2—2 therein, and with the lower end of the fastener or clip shown engaged therewith and with the isolator plate shown in position thereover.

The drawing FIG. 2 shows the lower upturned end 32 of a fastener or clip part 30 engaged to the overturned side edge 20 of the base member part 10. An isolator plate 40 is shown with the lower end of the fastener or clip 30 extending through a slot 42 that is provided in it. This particular drawing figure also shows that the isolator plate 40 rests on the ends of the base member 10, although only one such end is shown here.

The isolator plate 40 is of relatively light gage stock to allow some flexing and it has its side edges 44 and end edges 46 feathered or slightly chamfered to eliminate sharp edges that might become caught or embedded in the panels that it is engaged with and over which it moves; as is best shown in the last drawing figure.

Figure 3:
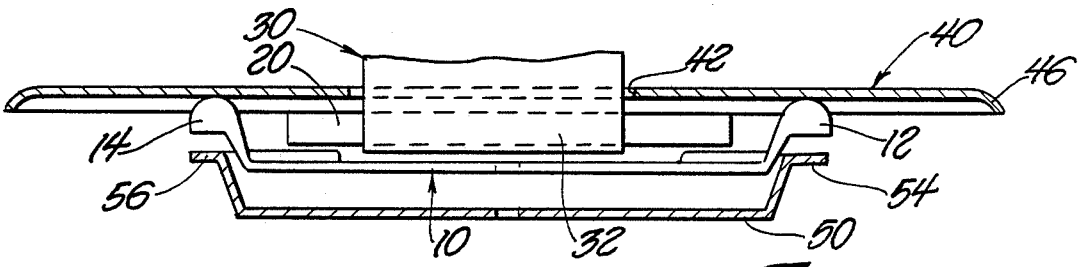
FIG. 3 is a side view of the base member of the first drawing figure, shown with the lower end of the fastener or clip engaged thereto, and the isolator plate positioned thereover, as in FIG. 2, and with a cross girt or brace, that is part of the roof supporting structure, shown disposed relatively therebeneath.

The drawing FIG. 3 is essentially a front plan view of the second drawing with a roof supporting cross brace or girt 50 shown disposed relatively below the base member and in position to have the base member fastened to it.

This particular drawing figure also shows that the length of the overturned edge 20 on the base member, at the side of the elongated opening in it, is appreciably longer than the width of the lower upturned end 32 of the fastener part 30, a accordingly shows that relative movement between the two, in the one sliding on the other, and to an appreciable exent, is possible.

This same drawing figure shows that the slot 42 in the isolator plate 40 is just sufficient to receive the lower end 32 of the fastener 30 therethrough and such that any relative movement of the fastener member, laterally on the base member, will cause the isolator plate to move with it. And, as previously mentioned, that the isolator plate rests on and slides over the ends of the base member part.

Figure 4:
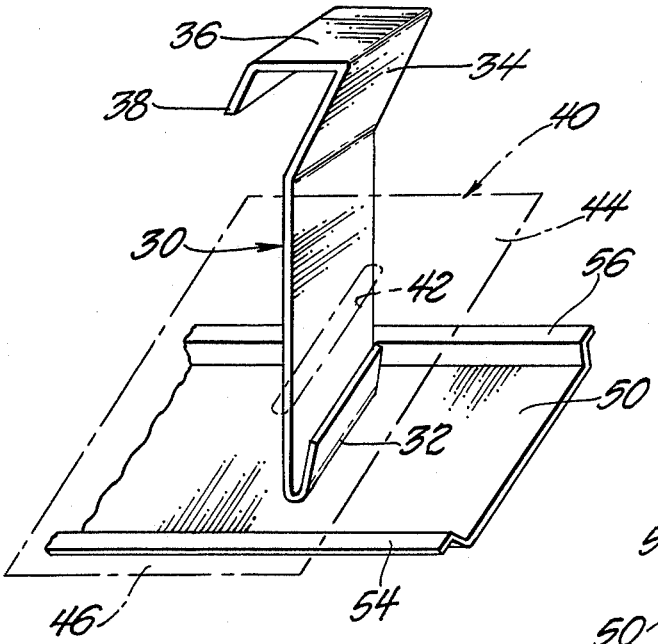
FIG. 4 is a perspective view of the fastener or clip shown relatively disposed over one of the cross girt or braces of the roof supporting structure and with the isolator plate engaged therewith. The base plate member is not shown in this figure.

Drawing FIG. 4 shows the fastener or clip 30 in full view and with its lower end 32 extended through the slot 42 in the isolator plate 40, shown in phantom, and with the fastener clip and isolator plate disposed relatively over a cross brace or girt 50. The relative length of the isolator plate, as being longer than the width of the cross brace or girt, is also better appreciated in this drawing view.

The fastener clip 30 is shown to have its upper end bent back at an angle, as at 34, then over or across, as at 36, and then downwardly, as at 38. This is its natural form; before being seam rolled between the upturned edges of next adjacent roof panels, in the course of having them secured together to provide a high profile standing seam roof structure and having the fastener means of this invention fastened therebetween.

Figure 5:
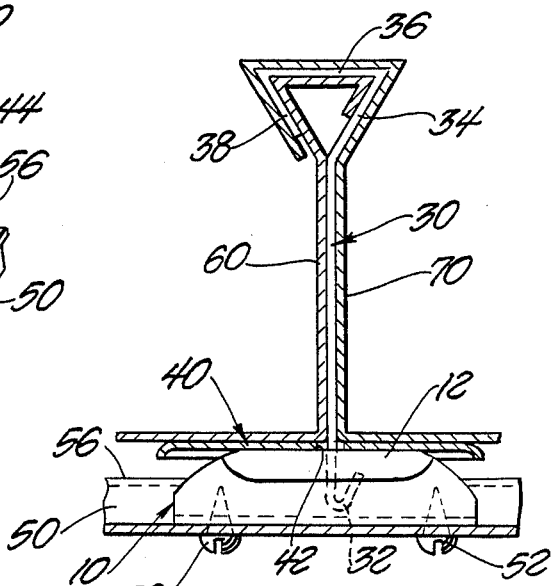
FIG. 5 is an end view of the base member, shown as fastened to a girt member and having the sliding clip and isolator plate engaged with it and the clip or fastener engaged with and made a part of the interlocked roof panels.

The last drawing FIG. 5 shows all the parts of the present invention is assembled relation.

The base member 10 is shown fastened to the cross brace or girt 50 by fasteners 52 and with the base member spanning the width of the cross brace or girt and having its ends 12 and 14 resting or laid on the channel bent side edges 54 and 56 of the roof structure supporting cross girt member.

The fastener or clip 30 has its lower end 32 engaged with the overturned edge 20 of the base member and extends through the slot 42 in the isolator plate, so that the latter is disposed about and carried by it.

The upper end of the fastener or clip 30 is received between the side edges of a pair of roof panels 60 and 70 and is seam rolled and formed between them in the course of sealing and forming the high standing rib profile of the roof being provided.

As shown, this disposes the upper end of the fastener in locked engagement with the roof panels and with the isolator plate 40 carried on its lower end. And, with the fastener 30 itself engaged to the base member 10, by its hooked end, the roof panels 60 and 70 are in turn held and relatively fastened to the base member; which is itself fastened to the cross braces or girt of the roof supporting structure.

Any elongation or contraction of the roof panels, between the ridge of the roof and the eaves, due to temperature changes or for whatever reason, will cause the fastener 30 to be relatively moved with them. And this, in turn, means that the lower hooked end of the fastener will slide relatively on the overturned edge of the base member.

At the same time, the isolator plate, lying as it does under and between the lower surfaces of the two next adjacent roof panels and over the base member, will slide on the upturned ends of the base member. And, the roof panels themselves will not be subject to the friction and wear that would otherwise occur if they were themselves directly engaged with the upturned ends of the base member.

The isolator plate, as provided for by this invention, thereby protects the roof panels against the friction and wear that might otherwise cause eventual roof damage.

I claim:

1. In a sheet metal roofing system including roof panels supported on a roof support structure and having adjacent side edges seamed together to define a continuous roof covering, and roof panel fastener clip means secured to the roof support structure and to the seamed edges of the roof panels to secure the roof panels to the roof support structure while enabling relative lateral movement between the roof panels and the roof support structure, the improvement comprising:

a base plate secured to the roof support structure beneath the roof panels at the seamed edges thereof and having fastener clip attaching means formed thereon, said fastener clips having complemental attaching means engaged with the attaching means on the base plate for attaching the roof panels to the base plate and thus to the roof support structure while enabling relative lateral movement between the roof panels and the base plate; and an isolator plate engaged between said roof panels and said base plate at said fastener clip locations, said isolator plate resting on said base and being carried by said fastener clips for movement with said roof panels relative to the base plate, whereby the isolator plate protects the roof panels from frictional contact with the base plate.

2. A roof panel locking system as claimed in claim 1, wherein:

said attaching means on said base plate and said fastener clip means comprises interengaged hook-like flanges on the base plate and fastener clip means, respectively, aligned longitudinally with said roof panel seams; and said hooked flanges are longitudinally slidable relative to one another to accommodate said relative lateral movement between the base plate and roof panels.

3. A roof panel locking system as claimed in claim 2, wherein:

said base plate has upstanding rub rails formed thereon; and said isolator plate rests on said rub rails.

4. A roof panel locking system as claimed in claim 3, wherein:

said isolator plate is substantially flat in configuration, and is of a size to overlie and extend beyond the boundaries of said base plate, said isolator plate having an opening therein through which said fastener clip means is closely received, whereby the isolator plate is carried by the fastener clip means.

5. A roof panel locking system as claimed in claim 4, wherein:

said roof support structure includes elongate channel-shaped roof girts having upstanding side flanges; and said base plate is sized and shaped to fit cross-wise in said girt, with said rub rails being disposed on and above said side flanges.

6. A roof panel locking system as claimed in claim 5, wherein:

fastening means is engaged between said girt and said base plate, securing said base plate to said girt.

7. A roof panel locking system for securing longitudinally seamed roof panels to a roof support structure so that the roof panels can move laterally with respect to the support structure, comprising:

a base plate adapted to be secured to the roof support structure beneath the roof panels;

a roof panel fastener clip having fastening means on a lower end thereof for attachment to said base plate, said base plate having complemental fastening means for cooperation with the fastening means on the clip so that the clip can move laterally with respect to the base plate, said clip being adapted to extend into secured relationship with a seam between adjacent roof panels to hold the panels to the base plate and thus to the roof support structure; and an isolator plate having an opening therethrough for closely receiving said clip, so that said isolator plate is carried by the clip, said isolator plate adapted to lie between said base plate and roof panels secured to said clip and movable with said clip relative to said base plate to protect the roof panels from frictional engagement with said base plate.

* * * * *